US006628092B2

(12) United States Patent
Beij et al.

(10) Patent No.: US 6,628,092 B2
(45) Date of Patent: Sep. 30, 2003

(54) BALLAST AND METHOD OF FEEDING A FLUORESCENT LAMP

(75) Inventors: Marcel Beij, Eindhoven (NL); Arnold Willem Buij, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/050,251

(22) Filed: Jan. 16, 2002

(65) Prior Publication Data

US 2002/0097010 A1 Jul. 25, 2002

(30) Foreign Application Priority Data

Jan. 22, 2001 (EP) ..... 01200216

(51) Int. Cl.[7] ..... H05B 41/00
(52) U.S. Cl. ..... 315/291; 315/307; 315/DIG. 4
(58) Field of Search ..... 315/291, 307, 315/308, 209 R, DIG. 4, 219

(56) References Cited

U.S. PATENT DOCUMENTS 4,958,108 A * 9/1990 Jorgensen ..... 315/307
5,339,335 A * 8/1994 Molnar ..... 375/350
5,528,111 A * 6/1996 Konopka et al. ..... 315/291
5,612,595 A * 3/1997 Maheshwari ..... 315/291
6,150,772 A * 11/2000 Crane ..... 315/291
6,307,765 B1 * 10/2001 Choi ..... 363/134

FOREIGN PATENT DOCUMENTS

EP 0602780 A2 6/1994
EP 0605052 A1 7/1994

* cited by examiner

*Primary Examiner*—Don Wong
*Assistant Examiner*—Ephrem Alemu

(57) ABSTRACT

A method of feeding a fluorescent lamp, wherein the actual power through the lamp is measured, an actual power value is determined by means of a moving weighted average of a series of most recently measured actual power values, wherein a measured actual power value is substituted with an alternative value if said measured value exceeds a predetermined maximum difference with respect to said average value, and wherein said measured actual power value is compared with a target value, and the power through the lamp is adjusted in the case of a significant difference.

7 Claims, 1 Drawing Sheet

BALLAST AND METHOD OF FEEDING A FLUORESCENT LAMP

BACKGROUND OF THE INVENTION

The invention relates to a method of feeding a fluorescent lamp, wherein the actual power through the lamp is measured, an actual power value is compared with a target power value, and, in the case of a significant difference, the power sent through the lamp is adapted.

Such a method is disclosed in U.S. Pat. No. 5,952,793. The light output of a fluorescent lamp, such as a TL lamp, is also determined by the power flowing through such a lamp. This power must be controlled by a ballast, i.e. a power supply that makes sure that the power through the lamp is stabilized. The power through the lamp depends to a substantial degree on many factors, such as the lamp type, the temperature, the condition of the lamp and the lamp electrodes, etc. Therefore, use is made of a control circuit that enables the right amount of power to be accurately sent through the lamp, and the actual power through the lamp is continuously measured by means of an analog-to-digital (A/D) converter, and, in the case of a deviation from the target power, the power sent through the lamp by the ballast is adapted. Frequently, such a ballast comprises dim means that are capable of setting the target power value.

A drawback of the known method resides in that during measuring the actual power by means of said A/D converter, peaks and other irregularities occur, which are not visible but which may cause the control by the ballast to become unstable. This problem is solved in known manner by filtering the analog signal by means of various filters before the signal is sampled. A drawback of this solution is that it causes the response time of the system to be slowed down. In addition, different signals require different filters, so that the hardware has to be adapted continually. Besides, filters in the form of hardware are voluminous and comparatively expensive.

SUMMARY OF THE INVENTION

It is an object of the invention to provide an inexpensive, efficient method and ballast for feeding a fluorescent lamp, said method and said ballast enabling a short response time to be achieved and/or being capable of being flexibly employed for different lamp types and under different conditions.

To achieve this, the actual power value is determined by a moving weighted average of a series including the last-measured actual power values, a measured actual power value being substituted with a replacement value if said measured actual power value exhibits a deviation relative to the average power value that exceeds a predetermined maximum deviation. Therefore, instead of filtering the analog signal, a correction is made in the digital samples originating from the A/D converter. If the value of a sample deviates more than a predetermined percentage, for example 10%, from the (weighted) average of the series of samples last taken, then this value is substituted with a replacement value. Preferably, this replacement value is equal to the closest, predetermined, maximum deviating value, for example the average value plus or minus 10%. In this manner, the influence of short-lived peaks in the signal is moderated and a digital solution is offered that is flexible, because it is programmable, and that enables a shorter response time than analog filters. The average may be an ordinary average of the last series of measured values, however, it is alternatively possible to assign more weight to the most recently measured values.

Preferably, if the target power value changes, the predetermined maximum is temporarily increased until the actual power has approximated the new target power value. By virtue thereof, a quick response by the lamp is possible when the user changes the dim setting. If the maximum is set to "infinite", this means that correction of peaks in the signal does not take place at all. And anyway peak correction is not necessary as in the case of a new dimmer setting, a stable light output of the lamp is temporarily less important.

Preferably, the predetermined maximum deviation can be adjusted in dependence on the target power value. This is important, particularly, in the case of a low target power value. Let us assume, for example, that the power may have a digital value in the range between 0 and 255 (1 byte). If the maximum deviation is defined as a percentage (for example 10%) of the average value, then the problem arises that in the event of a low average value (in this case below 10), the maximum deviation is smaller than the smallest possible digital representation, i.e. the number 1. Therefore, the maximum deviation must at least be set to (digital) 1.

The invention also relates to a ballast for feeding a fluorescent lamp, which ballast comprises a control circuit for controlling the power through the lamp, which control circuit includes sampling means capable of measuring the actual power through the lamp, processor means capable of determining an actual power value by calculating a moving weighted average of a series of last-measured actual power values, and capable of substituting a measured actual power value with a replacement value if said measured actual power value exhibits a deviation in excess of a predetermined maximum deviation from the average value, and said processor means also being capable of comparing an actual power value with a target power value, and of adapting the power sent through the lamp in the case of a significant difference.

These and other aspects of the invention will be apparent from and elucidated with reference to an exemplary embodiment.

DETAILED DESCRIPTION OF THE INVENTION

Figure 1:
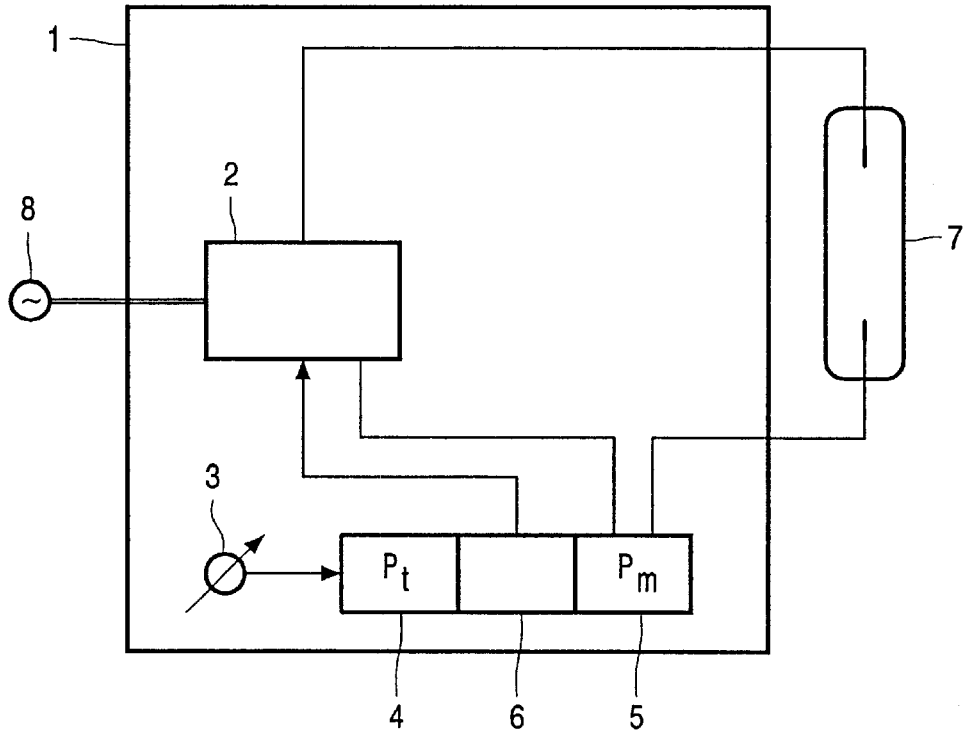
FIG. 1 diagrammatically shows a ballast in accordance with the invention.

In accordance with FIG. 1, a ballast 1 comprises a power supply 2, a dimmer 3 for setting a target power value Pt in memory means 4. The ballast 1 additionally includes a control circuit comprising an analog-to-digital (A/D) sampling device 5 that measures the power Pm through the fluorescent lamp 7, a processor 6 that compares the measured value Pm with the target value Pt. If the measured power Pm differs from the target power Pt set by the dimmer 3, then the processor 3 orders the power supply 2 to adapt the power sent through the lamp 7.

The sampling device 5 comprises an analog-to-digital converter. A problem encountered during measuring the power Pm is that the analog input signal is sensitive to high-frequency external interference originating, for example, from other apparatus connected to the mains, or from the ballast itself. This interference may lead to short-lived peaks in the signal which, however, are not representative of the power that is actually sent through the lamp 7. The control circuit does react, however, to this measuring signal, as a result of which the control of the lamp 7 may become more or less unstable. According to a known manner of reducing the effect of such short-lived peaks on the behavior of the control circuit, the analog measuring signal is subjected to a filtering operation. The filters used for this purpose are comparatively expensive, however, and also lead to a longer response time of the control system. In addition, it is difficult to adapt such filters to varying conditions.

Figure 2:
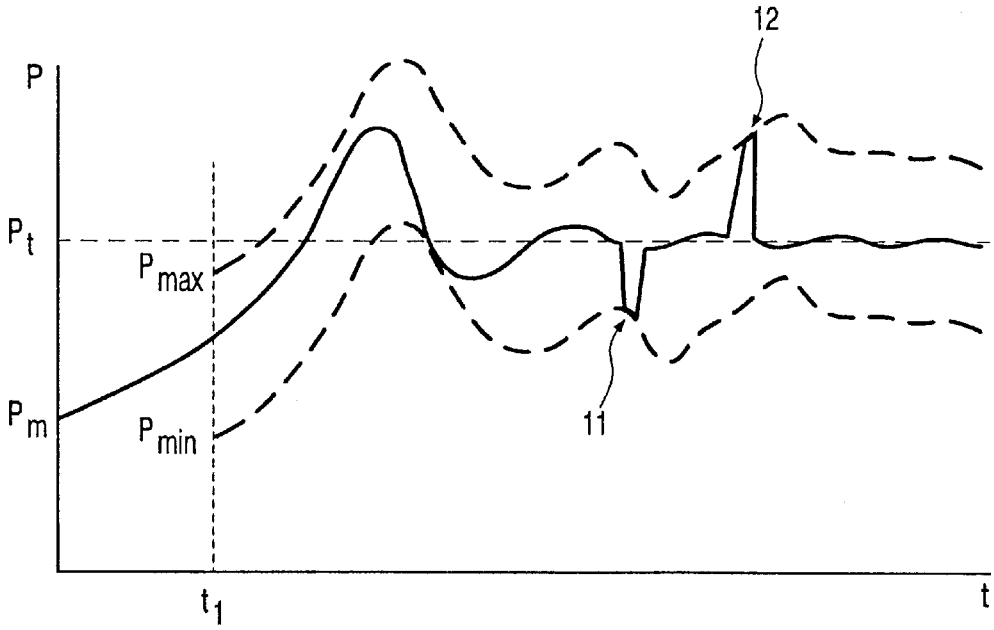
FIG. 2 shows a graph of a power signal that is measured and corrected by applying the invention.

Therefore, in accordance with the invention, instead of using filters to remove peaks from the analog signal, the digital signal originating from the A/D converter is subjected to a digital operation carried out by the processor 6. This will be illustrated with reference to FIG. 2. In said Figure, the target power value Pt set by the dim means 3 is represented by means of the horizontal dashed line. The solid line Pm represents the (corrected) digital measuring signal as a function of time. The Figure shows the situation where a new (higher) target value Pt is set by the dimmer 3, so that the control circuit will cause the power sent through the lamp to adopt said new value, the power sent through the lamp being indicated by means of Pm. As long as the measuring signal Pm exhibits a large deviation relative to the target value Pt, no correction of the signal Pm takes place in order to obtain the quickest possible response by the system. In such a case, some degree of instability of the system caused by the influence of interference peaks is not inconvenient as the light output of the lamp 7 is changing anyway and some fluctuation in the light output will not be experienced as disturbing by the user at such a moment in time. However, when the measuring signal Pm approximates the target value Pt, indicated in the graph by means of t1, the correction algorithm that contributes to stabilization of the measuring signal is put into operation.

For this purpose, the processor 6 calculates an average value of the measuring signal, resulting from the measurements carried out during, for example, the last 100 ms. If a subsequent measurement deviates more than, for example, 10% from said average value, it is assumed that this deviation is caused by an interference peak, and the actually measured value is substituted by the processor with a replacement value that is equal to the smallest deviating value Pmin or the largest deviating value Pmax, dependent upon which value is closest to the actually measured signal Pm. In the graph, Pmin and Pmax, which in this case are, respectively, 10% below and 10% above said average value, are indicated by means of dashed lines. The Figure shows that in the case of short-lived peaks 11, 12, the method described herein causes the measuring signal to be smoothed and, hence, the influence of these peaks 11, 12 on the operation of the control circuit remains limited.

The method described herein can be carried out in a programmable environment enabling simple changes to be made in the behavior of the control circuit. It is alternatively possible, however, to fix this functionality by means of hardware.

What is claimed is:

1. A method of feeding power to a fluorescent lamp, comprising measuring a value of the actual power through the lamp, comparing the actual power value with a target power valuer and, in the case of a significant difference, adjusting the power sent through the lamp, wherein the actual power value is determined by calculating a moving weighted average of a series of last-measured actual power values and substituting for the measured actual power value a replacement value if said measured actual power value exhibits a deviation relative to the weighted average power value that exceeds a predetermined maximum deviation.

2. A method as claimed in claim 1, wherein the replacement value is equal to the closest, predetermined, maximum deviating value.

3. A method as claimed in claim 1, characterized in that, if the target power value changes, the predetermined maximum deviation is temporarily increased until the actual power has approximated the new target power value.

4. A ballast for feeding power to a fluorescent lamp, which ballast comprises a control circuit for controlling the power through the lamp, which control circuit includes sampling means capable of measuring a value of the actual power through the lamp, and processor means capable of comparing the actual power value with a target power value and of adjusting the power sent through the lamp in the case of a significant difference, characterized in that the processor means is capable of determining the actual power value by calculating a moving weighted average of a series of last-measured actual power values, and of substituting for the measured actual power value a replacement value it said measured actual power value exhibits a deviation in excess of a predetermined maximum deviation from said weighted average power value.

5. A ballast as claimed in claim 4, characterized in that the sampling means comprises an analog-to-digital converter.

6. A ballast as claimed in claim 4, characterized in that the ballast comprises dim means capable of setting the target power value.

7. A ballast as claimed in claim 4, characterized in that the predetermined maximum deviation is adjusted in dependence upon the target power value.

* * * * *